US005728039A

United States Patent [19]

Knelson

[11] Patent Number: 5,728,039

[45] Date of Patent: Mar. 17, 1998

[54] CENTRIFUGAL SEPARATOR WITH PULSED FLUID INJECTION

[76] Inventor: Benjamin Knelson, 20321-86th Ave., Vancouver, Canada, V3A 6Y3

[21] Appl. No.: 788,496

[22] Filed: Jan. 28, 1997

[51] Int. Cl.[6] ..... B04B 11/00

[52] U.S. Cl. ..... 494/29; 494/37

[58] Field of Search ..... 494/1, 5, 23, 27–30, 494/37, 45, 56, 80, 85; 210/781

[56] References Cited

U.S. PATENT DOCUMENTS

| | | | |
|---|---|---|---|
| 1,473,421 | 11/1923 | Eccleston | 494/29 |
| 1,557,672 | 10/1925 | Doerner | 494/29 X |
| 1,594,501 | 8/1926 | Eccleston | 494/29 |
| 1,718,547 | 6/1929 | Eccleston | 494/29 |
| 4,608,040 | 8/1986 | Knelson . | |
| 4,776,833 | 10/1988 | Knelson . | |
| 4,846,781 | 7/1989 | Knelson | 494/27 |
| 5,222,933 | 6/1993 | Knelson et al. . | |
| 5,338,284 | 8/1994 | Knelson . | |
| 5,586,965 | 12/1996 | Knelson . | |

FOREIGN PATENT DOCUMENTS

22055/35 4/1936 Australia .

*Primary Examiner*—Charles E. Cooley
*Attorney, Agent, or Firm*—Adrian D. Battison; Murray E. Thrfit

[57] ABSTRACT

A centrifuge bowl of the type having a base onto which the intermixed particulate materials in slurry form is fed for passing over the peripheral wall of the bowl includes a plurality of annular recesses at axially spaced positions on the peripheral wall with each recess having a plurality of openings at the base of the recess communicating with the jacket on the outside of the peripheral wall. Water is supplied through a channel in the support shaft of the bowl via a rotary union on the shaft which is arranged to cause a fluctuation in the flow rate of water passing to the jacket. The flow rate is maintained positive at all times but fluctuates between a maximum and minimum value. The minimum value of the flow rate is sufficient to maintain a flow through the openings which prevents the outward passage of particles under centrifugal forces.

9 Claims, 2 Drawing Sheets

CENTRIFUGAL SEPARATOR WITH PULSED FLUID INJECTION

This invention relates to a centrifugal separator of the type which includes a centrifuge bowl having a peripheral wall over which intermixed particulate materials are passed to effect separation of heavier materials for collection on the wall while lighter materials escape from the bowl through an open mouth. The materials on the wall are fluidized by injecting fluidizing liquid through openings in the wall. The supply of fluidizing liquid is pulsed to provide a cyclical variation in the flow rate.

BACKGROUND OF THE INVENTION

Centrifugal separators of this general type are shown in prior U.S. Pat. Nos. 4,776,833, 4,608,040, 5,222,933, 5,338,284, and 5,586,965. All of these patents disclose an arrangement in which the peripheral wall includes one or more annular recesses at axially spaced positions along the length of the bowl so that the heavier materials collect in the recess. Injection openings are located at the bosom of the recess so as to fluidize the materials within the recess. In all of these patents the fluidizing liquid is injected to the constant rate so as to continually fluidize the material within the recess.

Australian patent application 22055/35 of MacNicol discloses an arrangement of this general type in which the "washing or agitating liquid or agitating fluid may be discharged at regulated pressure either continuously or intermittently to cause disturbance, agitation or diffusion of the lighter particles". Thus this patent discloses an arrangement in which the injected fluidizng liquid is pulsed, that is supplied intermittently, so as to cause agitation of the fluidized bed within the recess.

However the present inventor has identified that this arrangement is unsatisfactory.

SUMMARY OF THE INVENTION

It is one object of the present invention, therefore, to provide an improved method of centrifugal separation using pulsed injection.

According to one aspect of the invention there is provided a method for separating intermixed particulate materials of different specific gravity comprising: providing a centrifuge bowl having a base and a peripheral wall surrounding an axis passing through the base and generally upstanding from the base to an open mouth; rotating the bowl about the axis; feeding the intermixed particulate materials into the bowl so that during rotation of the bowl the intermixed particulate materials flow over the peripheral wall for discharge from the open mouth; collecting the materials discharged from the open mouth; providing at least one annular recess on the peripheral wall over which the materials pass so that heavier material particles tend to collect in the recess and lighter material particles tend to pass over the recess to the open mouth for discharge from the open mouth; fluidizing said particles in said at least one annular recess by providing a plurality of openings through the peripheral wall at said at least one recess and injecting fluidizing liquid through the openings; and collecting the heavier material particles from said at least one recess; wherein the fluidizing liquid is pulsed such that a flow rate of the liquid through the openings is increased and decreased cyclically, the flow rate when decreased being arranged to maintain a positive flow of liquid into the recess through the openings which is at a rate sufficient to prevent outward flow of particles under centrifugal forces from the recess through the openings.

Preferably the method includes providing as said at least one recess at least two recesses.

Preferably the method includes providing in said at least one recess a plurality of angularly spaced discharge openings each extending through the peripheral wall substantially radially outwardly therefrom, and arranging said discharge openings to cooperate with said second guide means for substantially continuously collecting said heavier material particles.

Preferably the method includes arranging said openings to inject said fluidizing liquid in a direction to cause said heavier material particles in said at least one recess to move circumferentially relative to the peripheral wall of the bowl.

Preferably the flow rate when decreased is at least one half of the flow rate when increased.

Preferably the flow rate when decreased is at least three quarters of the flow rate when increased.

Preferably the change in flow rate is sufficient to cause agitation of the particles in the recess.

Preferably there is provided a jacket mounted on an outside of the bowl for communicating the liquid to the openings, wherein the liquid is communicated to the jacket by passing through a coupling having a member which is stationary relative to the bowl and wherein the coupling provides a variable orifice which is varied in response to the rotation of the bowl such that the variation in flow rate is cyclical in response to the rotation of the bowl.

Preferably the coupling comprises a rotary union mounted on a support shaft of the bowl.

One embodiment of the invention will now be described in conjunction with the accompanying drawings in which:

DETAILED DESCRIPTION

Figure 1:
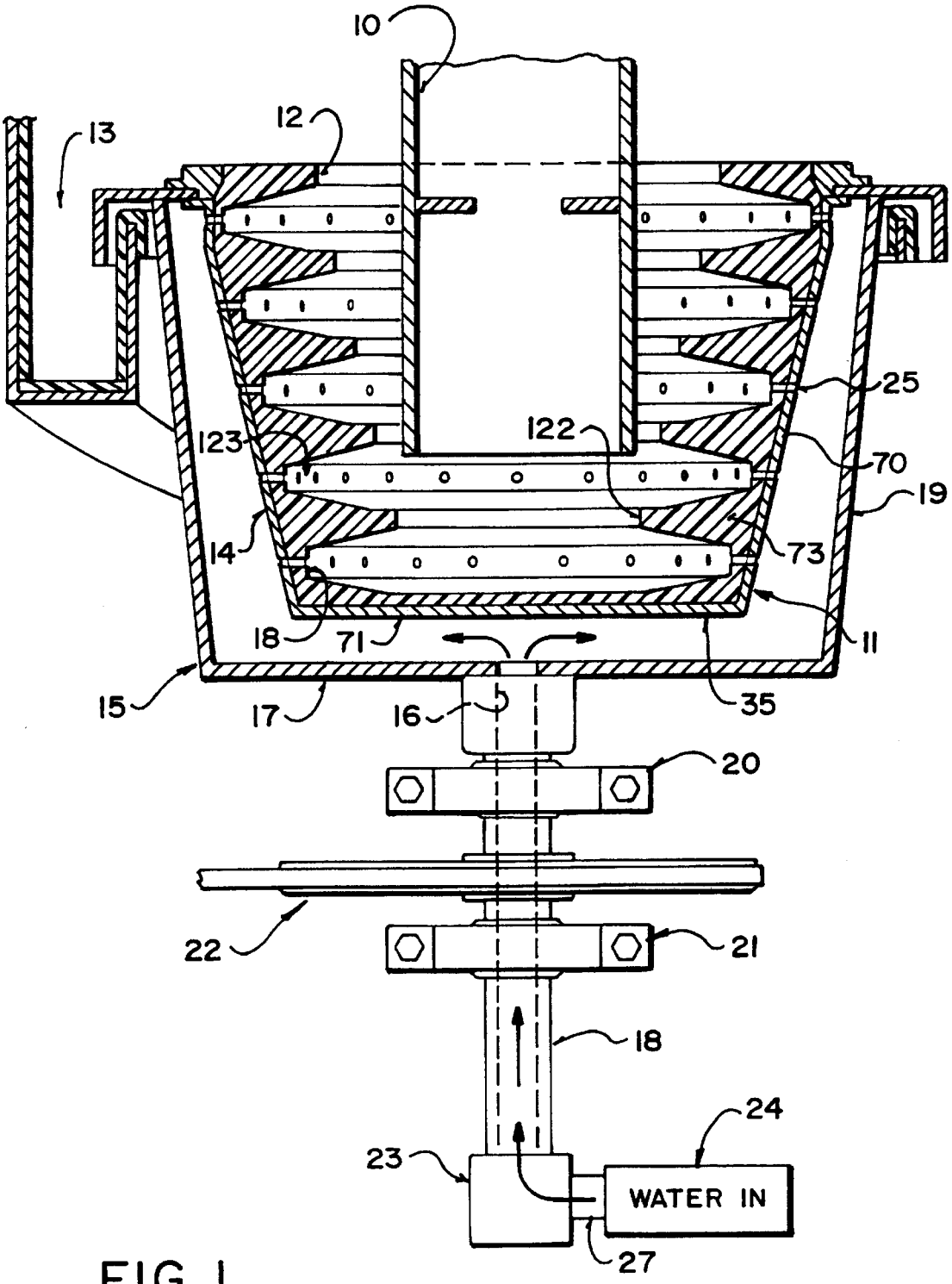
FIG. 1 is a vertical cross sectional view through a centrifuge bowl according to the present invention.

The illustration in FIG. 1 is one example of a machine of the present type and this illustration is taken from U.S. Pat. No. 4,776,833 of the present inventor to which reference can be made for a full and detail description of the operation of this device. The other patents of the present invention mentioned above also provide further details of various improvements and modified arrangements and the disclosure of all of these patents is incorporated herein by reference.

Briefly, the centrifuge device comprises a bowl 11 having a peripheral wall 14 and a base 35. The peripheral wall has formed thereon a plurality of annular rings 122 defining between the rings recesses 123. The peripheral wall is defined by an outer steel layer 70 and an inner molded layer 73. Each recess has a base 18. A feed duct 10 is arranged to direct intermixed particulate materials in a slurry form onto the base 35 so that the materials can turn onto the peripheral wall for flowing across the peripheral wall so that heavier materials collect within the recesses and lighter materials escape over an open mouth 12 for collection within a launder 13.

Around the bowl 11 is mounted a jacket 15 having a base 17, the base being attached to a support shaft 18 having a longitudinal central duct 16 for communicating water through the shaft into an area between the base 17 and a bottom surface 71 of the base 35 of the bowl. The jacket further includes a peripheral wall 19 spaced outwardly from the peripheral wall 70 so as to allow the fluidizing liquid to access the outside surface of the bowl.

The shaft 18 is mounted in bearings 20 and 21 and is driven in rotation by a pulley and belt arrangement 22 so that the shaft and therefore the bowl and jacket are rotated at high speed to provide a centrifuge effect.

The shaft 18 communicates with a rotary union 23 for communication of water from a supply 24 into the duct 16 within the shaft.

The base 18 of each recess includes a plurality of angularly spaced openings 25 around the recess for injecting water into the recess for fluidizing the materials within the recess. As shown in U.S. Pat. No. 4,608,040 of the present inventor, the injection openings 25 are arranged tangentially or at least at an angle to the radius of the bowl so that there is a tendency of the injected liquid to move angularly around the recess.

Figure 3:
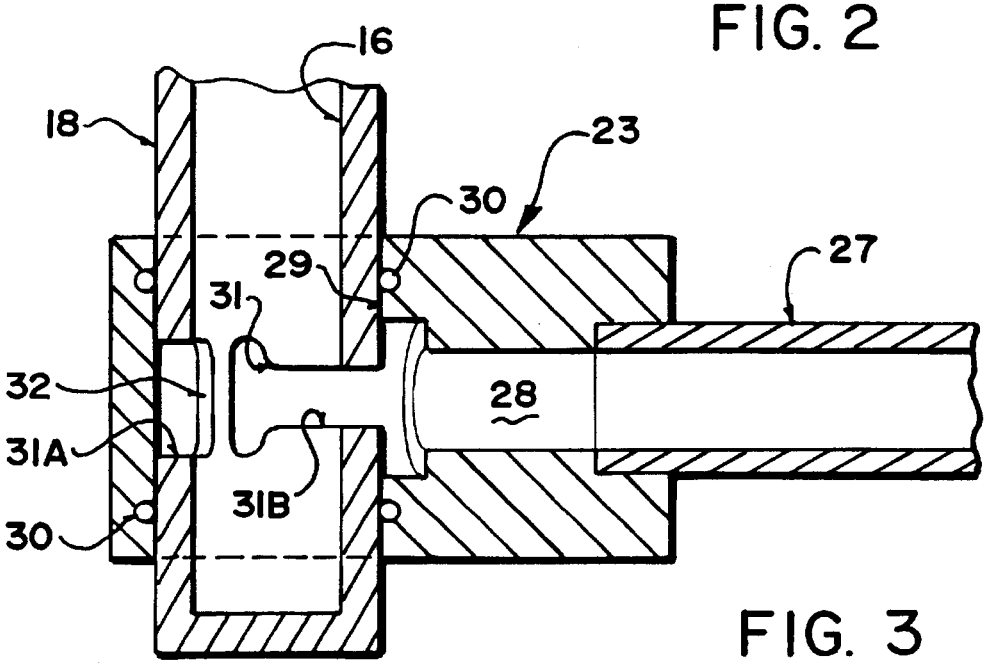
FIG. 3 is a cross sectional view on an enlarged scale showing the rotary union of FIG. 1.

All of the above description is based upon the prior patents and therefore is merely a description of the prior art arrangements and shows only one example. Turning now to FIG. 3, the rotary union 23 is shown schematically mounted on the shaft 18. The rotary union comprises a fixed body which connects to an input duct 27 for the fluidizing water. The body 23 has a channel 28 communicating with an end face 29 which is part cylindrical so as to surround the outside surface of the shaft 18. A rubber O ring 30 is attached around the front face 29 so as to provide a seal of the front face around the front face. In this way the water from the duct 28 is applied only to one part of the outside surface of the shaft 18, which part is confined in an axial direction and is also confined in a direction around the shaft.

The shaft of course is rotating so that portion of the shaft which faces the open face 29 is changing as the shaft rotates. The shaft is formed with an opening 31 at an axially localized position corresponding to the end face 29. The opening 31 surrounds the shaft with connecting portions 32 bridging the opening so as to maintain the integrity of the shaft. The opening 31 includes a wider portion 31A and a narrower portion 31B so that as the shaft rotates the wider portion is firstly presented to the front face 29 and then the narrower portion is subsequently presented to the front face. This changing width in the slot presented to the front face provides a changing orifice which cyclically varies the flow rate of the liquid from the duct 28 into the channel 16 within the shaft. It will be noted however that the orifice defined by the slot 31 never closes so that there is always a proportion of the water flowing into the shaft.

Figure 2:
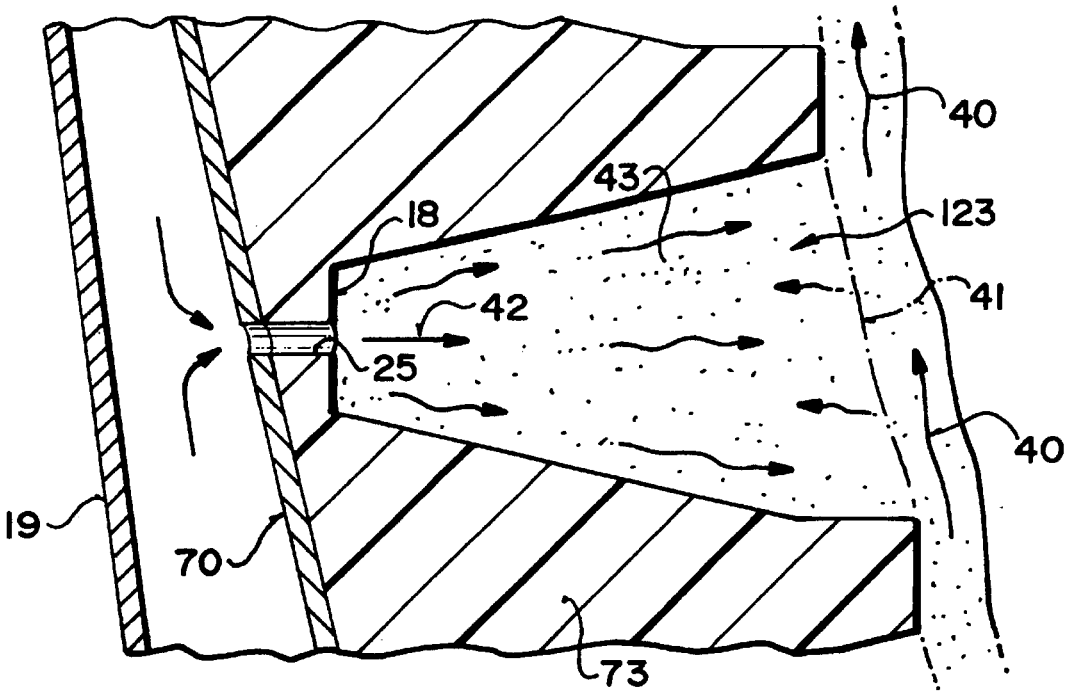
FIG. 2 is a similar cross sectional view showing one recess on an enlarged scale and showing the flow of fluid into and across the recess.

Turning now to FIG. 2, the water from the channel 16 is communicated to the jacket and to the area of the jacket surrounding the openings 25. The water supply thus passes through the openings 25 at a flow rate through each opening which is determined by the total flow rate through the duct 16 divided by the number of openings.

In FIG. 2, the materials flowing over the peripheral wall from the feed duct are indicated at 40 and these materials pass over an open mouth 41 of the recess. Heavier materials in particulate form thus tend to migrate into the recess while the lighter materials remain in or migrate into the flowing intermixed materials 40. The water 42 injected from the opening tends to fluidize the material 43 within the recess so that the process of separation of the heavier materials migrating toward the base 18 and the lighter materials migrating toward the flow 40 continues until sufficient heavier materials is collected to prevent the collection of further heavier materials whereupon the process is halted and the batch of heavier materials discharged.

In FIG. 2, the discharge of the heavy particles can also be effected by discharge ducts of the type illustrated and described in the aforementioned Pat. No. 5,338,284 of the present inventor.

Figure 4:
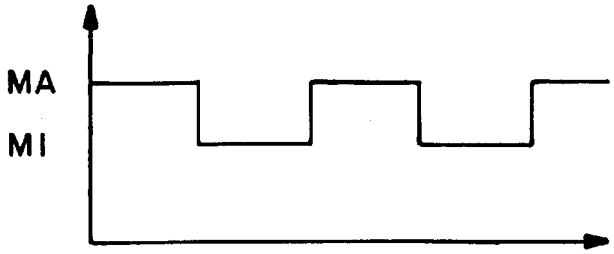
FIG. 4 is a schematic graphical illustration of the flow rate of the water through the openings.

The pulsing of the flow rate is effected between a maximum level MA and a minimum level MI as indicated in FIG. 4. These levels are selected by a selection of the size of the orifice in the shaft so that both levels are sufficient to maintain a flow of water through the openings 25 which is continuous in the sense that the flow is always positive flowing from the jacket into the recess. The minimum flow MI is selected so that it is sufficient to prevent flow of particles in the opposite direction under the centrifugal forces into and through the opening 25. It will be appreciated that the centrifugal forces generated by rotation of the bowl tend to force particles outwardly of the bowl and as the particles are heavier than the water there is a preferential flow of particles outwardly against the stream of water. If the stream of water moves too slowly in the positive direction into the recess then the particles begin to move against that stream outwardly into the opening. The flow of water is selected at the minimum level so that it is sufficient to prevent these particles from moving outwardly, that is the flow is at least equal to the rate necessary to overcome the differential in the flow of the particles. In practice, the maximum flow rate is selected to be slightly higher of the order of 10 percent higher than the flow rate which is selected when pulsing is not used and the minimum flow rate is selected to be of the order of 75 percent of the normal flow rate. Thus the minimum flow rate is at least 50 percent of and preferably approximately 70 to 75 percent of the maximum flow rate.

This fluctuation in the flow rate is sufficient to agitate the particles within the recess. However the minimum flow rate is sufficient to prevent particles from escaping out through the openings. If the particles are allowed to escape out through the opening then there becomes a sawing effect in which the particles rapidly abrade the opening and effect wear of the bowl to a level which cannot be accommodated.

It will be appreciated that the difference between the maximum and minimum flows will vary in dependence upon the angle of the opening to the radius since the closer the opening is to a radial opening, the greater the tendency of the particles to escape radially outwardly. It will also be appreciated that the opening cannot be directly tangential.

In the embodiments disclosed, the variation in flow rate is obtained by a varying orifice in the rotary union. However alternative arrangements (not shown) can be used which are independent of the rate of rotation of the bowl, such flow rate control devices which cyclically vary the flow rate are weel known to one skilled in this field and accordingly will not be described in detail. Such a device will allow the frequency of the cyclical variation to be modified to obtain the optimum effect.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method for separating intermixed particulate materials of different specific gravity comprising:

providing a centrifuge bowl having a base and a peripheral wall surrounding an axis passing through the base and generally upstanding from the base to an open mouth;

rotating the bowl about the axis;

feeding the intermixed particulate materials into the bowl so that during rotation of the bowl the intermixed particulate materials flow over the peripheral wall for discharge from the open mouth;

collecting the materials discharged from the open mouth;

providing at least one annular recess on the peripheral wall over which the materials pass so that heavier material particles tend to collect in the recess and lighter material particles tend to pass over the recess to the open mouth for discharge from the open mouth;

fluidizing said particles in said at least one annular recess by providing a plurality of openings through the peripheral wall at said at least one recess and injecting fluidizing liquid through the openings;

and collecting the heavier material particles from said at least one recess;

wherein the fluidizing liquid is pulsed such that a flow rate of the liquid through the openings is increased and decreased cyclically, the flow rate when decreased being arranged to maintain a positive flow of liquid into the recess through the openings which is at a rate sufficient to prevent outward flow of particles under centrifugal forces from the recess through the openings.

2. The method according to claim 1 including providing as said at least one recess at least two recesses.

3. The method according to claim 1 including providing in said at least one recess a plurality of angularly spaced discharge openings each extending through the peripheral wall substantially radially outwardly therefrom, and arranging said discharge openings to cooperate with a guide means for substantially continuously collecting said heavier material particles.

4. The method according to claim 1 including arranging said openings to inject said fluidizing liquid in a direction to cause said heavier material particles in said at least one recess to move circumferentially relative to the peripheral wall of the bowl.

5. The method according to claim 1 wherein the flow rate when decreased is at least one half of the flow rate when increased.

6. The method according to claim 1 wherein the flow rate when decreased is at least three quarters of the flow rate when increased.

7. The method according to claim 1 wherein the change in flow rate is sufficient to cause agitation of the particles in the recess.

8. The method according to claim 1 wherein there is provided a jacket mounted on an outside of the bowl for communicating the liquid to the openings, wherein the liquid is communicated to the jacket by passing through a coupling having a member which is stationary relative to the bowl and wherein the coupling provides a variable orifice which is varied in response to the rotation of the bowl such that the variation in flow rate is cyclical in response to the rotation of the bowl.

9. The method according to claim 8 wherein the coupling comprises a rotary union mounted on a support shaft of the bowl.

* * * * *